US005954563A

United States Patent [19]

Spriggs

[11] Patent Number: 5,954,563

[45] Date of Patent: Sep. 21, 1999

[54] DEVICE FOR PROPELLING NOVELTY ITEMS

[76] Inventor: Harry J Spriggs, 2455 E. Glencove, Mesa, Ariz. 85213

[21] Appl. No.: 09/084,298

[22] Filed: May 26, 1998

[51] Int. Cl.[6] ..... A63H 37/00; F42B 4/00

[52] U.S. Cl. ..... 446/475; 102/357

[58] Field of Search ..... 446/475, 483, 446/14; 102/353, 357, 358, 351

[56] References Cited

U.S. PATENT DOCUMENTS

| | | | |
|---|---|---|---|
| 950,591 | 3/1910 | Braquier | 102/353 |
| 1,324,092 | 12/1919 | Worswick . | |
| 1,663,679 | 3/1928 | Carpenter | 446/475 X |
| 1,664,401 | 3/1928 | Craig | 446/475 |
| 1,785,770 | 12/1930 | Faber et al. | 102/357 |
| 3,626,415 | 12/1971 | Montgomery | 102/357 |
| 3,744,417 | 7/1973 | Kaneko | 102/357 |
| 4,374,494 | 2/1983 | Maury | 102/357 |
| 4,549,489 | 10/1985 | Billard et al. | 102/357 |
| 4,593,622 | 6/1986 | Fibranz | 102/530 |
| 4,791,870 | 12/1988 | Simpson | 102/357 |
| 5,015,211 | 5/1991 | Reveen . | |
| 5,304,096 | 4/1994 | Wilk . | |
| 5,512,003 | 4/1996 | Parker | 446/475 |
| 5,634,840 | 6/1997 | Watkins . | |

*Primary Examiner*—D Neal Muir
*Attorney, Agent, or Firm*—Michael I. Kroll

[57] ABSTRACT

A device (26) for propelling novelty items (28) comprising a structure (30) for holding the novelty items (28). A component (32) is for supporting the holding structure (30) in an upright position. A facility (34) in the supporting component (32) is for ejecting the novelty items (28) out of an open top end (36) of the holding structure (30) when activated.

17 Claims, 16 Drawing Sheets

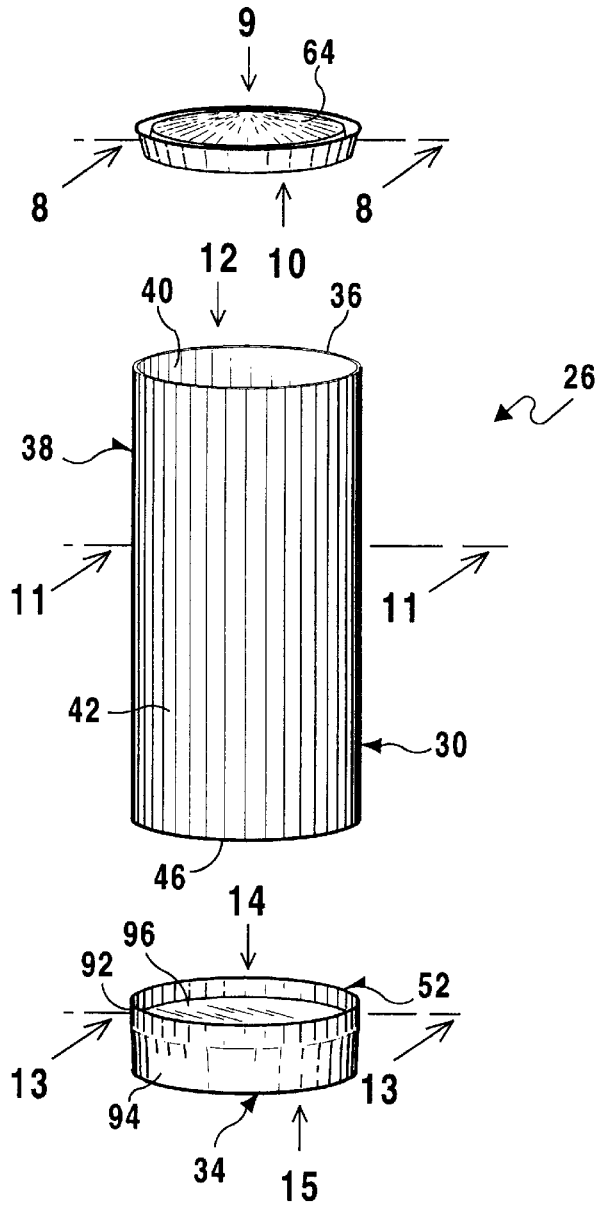
FIG 7
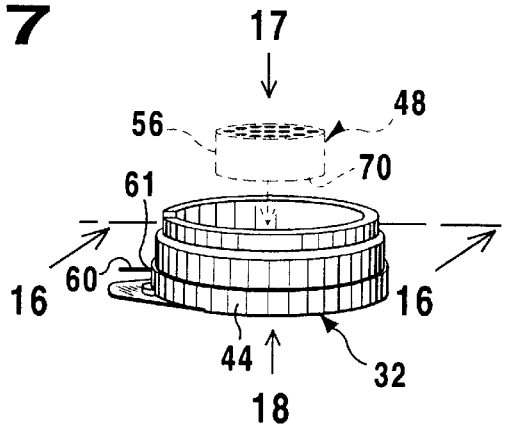

DEVICE FOR PROPELLING NOVELTY ITEMS

BACKGROUND OF THE INVENTION

1. Field of the Invention

The instant invention relates generally to confetti projectors and more specifically it relates to a device for propelling novelty items. The device for propelling novelty items consists of a tubular shaped canister for holding the novelty items. The novelty items are propelled by igniting a chemical based substance located at the base of the canister. The chemical based substance expands forcing a movable portion, whereupon the novelty items are ejected out of the canister. The device for propelling novelty items is safe to operate and can be used by the general public.

2. Description of the Prior Art

Numerous confetti projectors have been provided in prior art. For example, U.S. Pat. No. 1,324,092 to Worswick; U.S. Pat. No. 5,015,211 to Reveen; U.S. Pat. No. 5,304,096 to Wilk and U.S. Pat. No. 5,634,840 to Watkins all are illustrative of such prior art. While these units may be suitable for the particular purpose to which they address, they would not be as suitable for the purposes of the present invention as heretofore described.

WORSWICK, EDGAR THOMAS

APPARATUS FOR THROWING CONFETTI AND THE LIKE

U.S. Pat. No. 1,324,092

A confetti projector comprising a casing. A hollow friction member in the casing, near one end of the latter. A cushioning packing is in the end of the casing and around the friction member. A charge of confetti is in the casing. A solid explosive charge is arranged for movement in the friction member for ignition thereby and a cord is attached to the explosive charge and projects from the first named end of the casing.

REVEEN, TYRONE J.

CONFETTI CANNON

U.S. Pat. No. 5,015,211

A portable, lightweight confetti cannon for projecting confetti to heights of 30–40 feet in the air is used to create spectacular displays for rock concerts or stage shows. The cannon consists of a hollow barrel having a length of at least 3 feet and a length/diameter ratio of at least 20 having a CO2 cartridge radially mounted at its base. The cartridge is covered by an insulated grip. A valve is mounted between the cartridge and the barrel and has a cartridge puncturing mechanism which enables complete discharge of CO2 cartridge contents in less than three seconds .

WILK, PETER J.

ENTERTAINMENT SYSTEM AND ASSOCIATED METHOD

U.S. Pat. No. 5,304,096

An entertainment system comprises a housing, a first ejection mechanism in the housing for ejecting a first entertainment device from the housing, a second ejection mechanism in the housing for ejecting a second entertainment device from the housing, and a control unit operatively connected to the first ejection mechanism and the second ejection mechanism for sequencing the operation of the first ejection mechanism and the second ejection mechanism. Upon lapse of a predetermined interval after ejection of the first entertainment device such as confetti or streamers from the housing, a second entertainment device such as sparklers of fireworks spinners is automatically ejected from the housing. Predetermined sound effects such as music may be generated in a predetermined synchrony with the ejection of the entertainment devices.

WATKINS, JAMES O.

CONTROLLABLE CONFETTI PROJECTOR

U.S. Pat. No. 5,634,840

A system for launching confetti into the air is disclosed in which a gas cylinder is connected to a barrel containing confetti through a manually operated on-off valve. In a preferred embodiment of the invention, the valve is a pressure reduction valve, and the confetti comprises stacks of elongated tetragonal-shaped confetti.

SUMMARY OF THE INVENTION

A primary object of the present invention is to provide a device for propelling novelty items that will overcome the shortcomings of the prior art devices.

Another object is to provide a device for propelling novelty items that consists of a tubular shaped canister for holding the novelty items, which are propelled by igniting a chemical based substance located at the base of the canister which expands forcing a movable portion, whereupon the novelty items are ejected out of the canister.

An additional object is to provide a device for propelling novelty items that is safe to operate and can be used by the general public.

A further object is to provide a device for propelling novelty items that is simple and easy to use.

A still further object is to provide a device for propelling novelty items that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 7 is an exploded perspective view, showing all of the various components of the present invention.

Similar reference characters denote corresponding features consistently throughout the attached drawings.

DETAILED DESCRIPTION OF THE PREFERRED EMBODIMENTS

Figure 1:
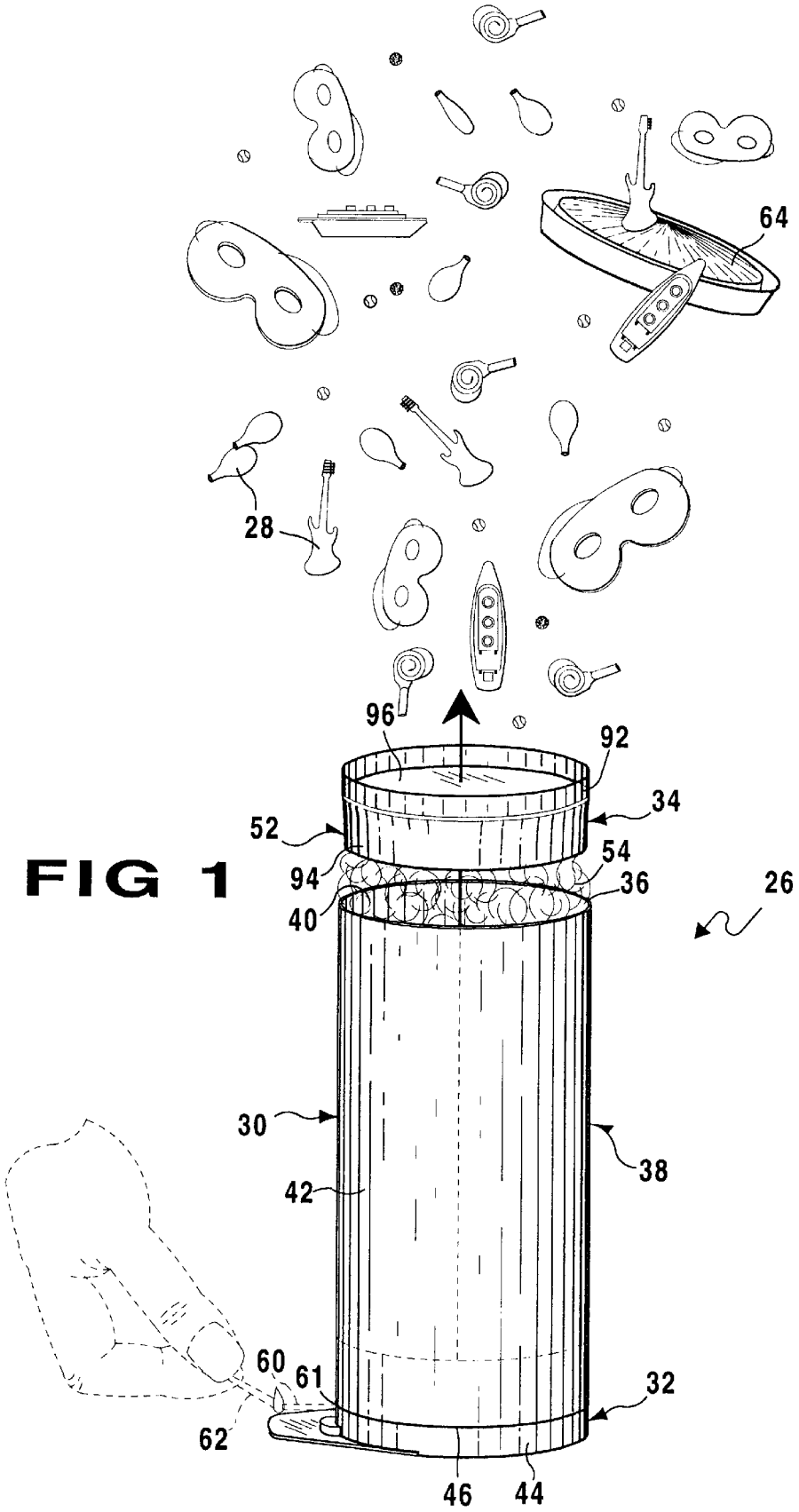
FIG. 1 is a perspective view of the present invention in use.
Figure 2:
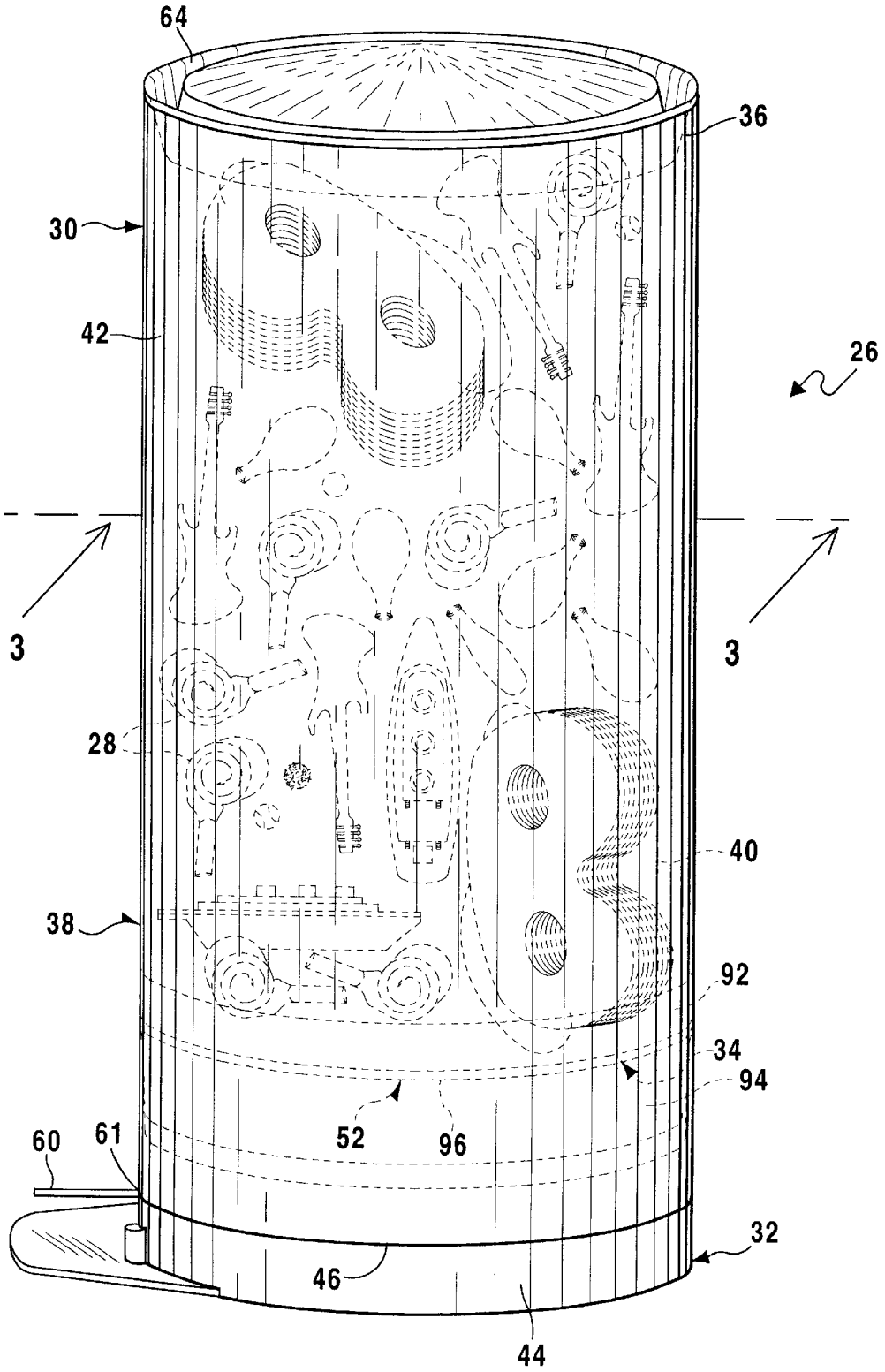
FIG. 2 is an enlarged perspective view of the present invention ready to be used.
Figure 3:
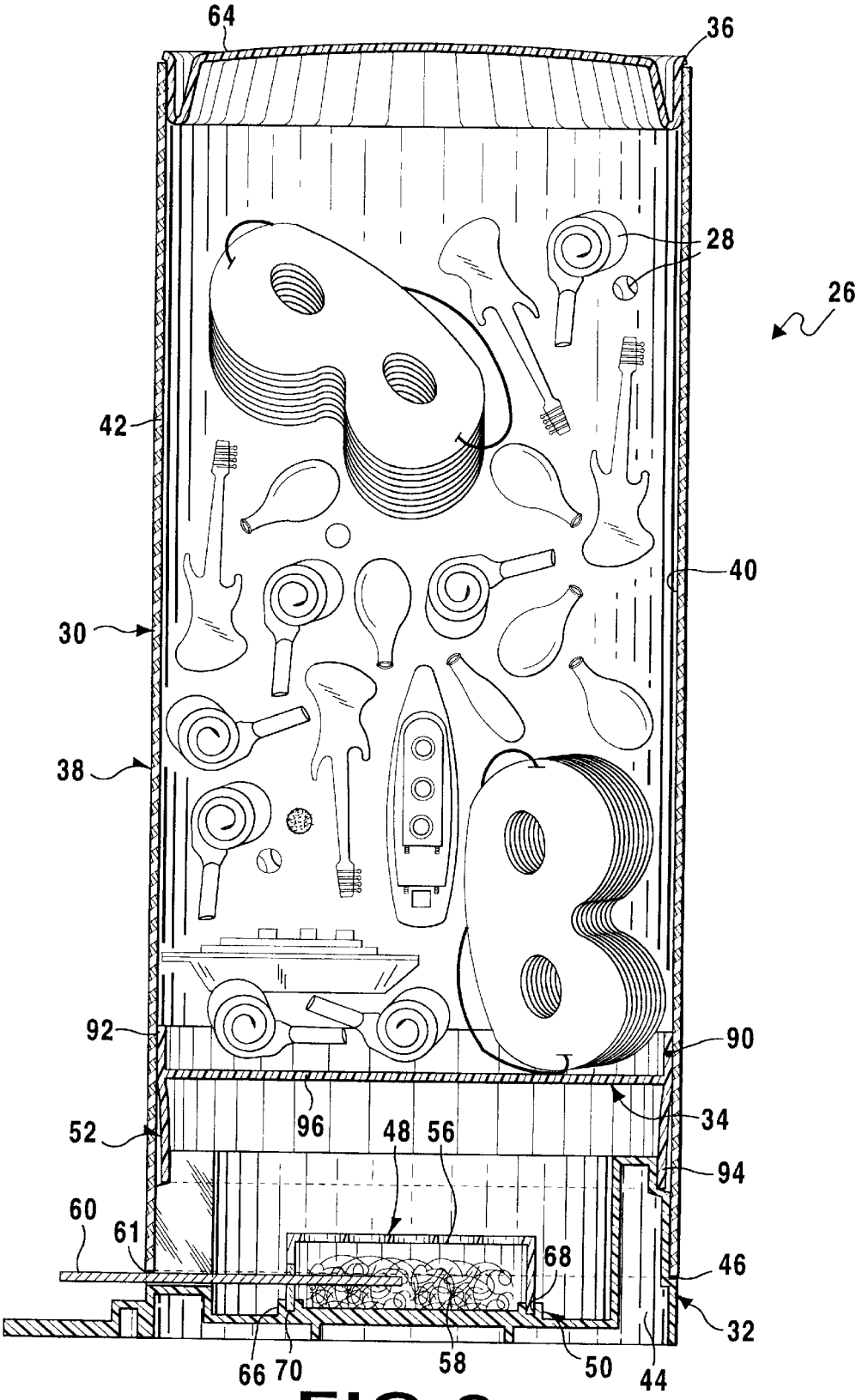
FIG. 3 is a cross sectional view taken along line 3—3 in FIG. 2.
Figure 4:
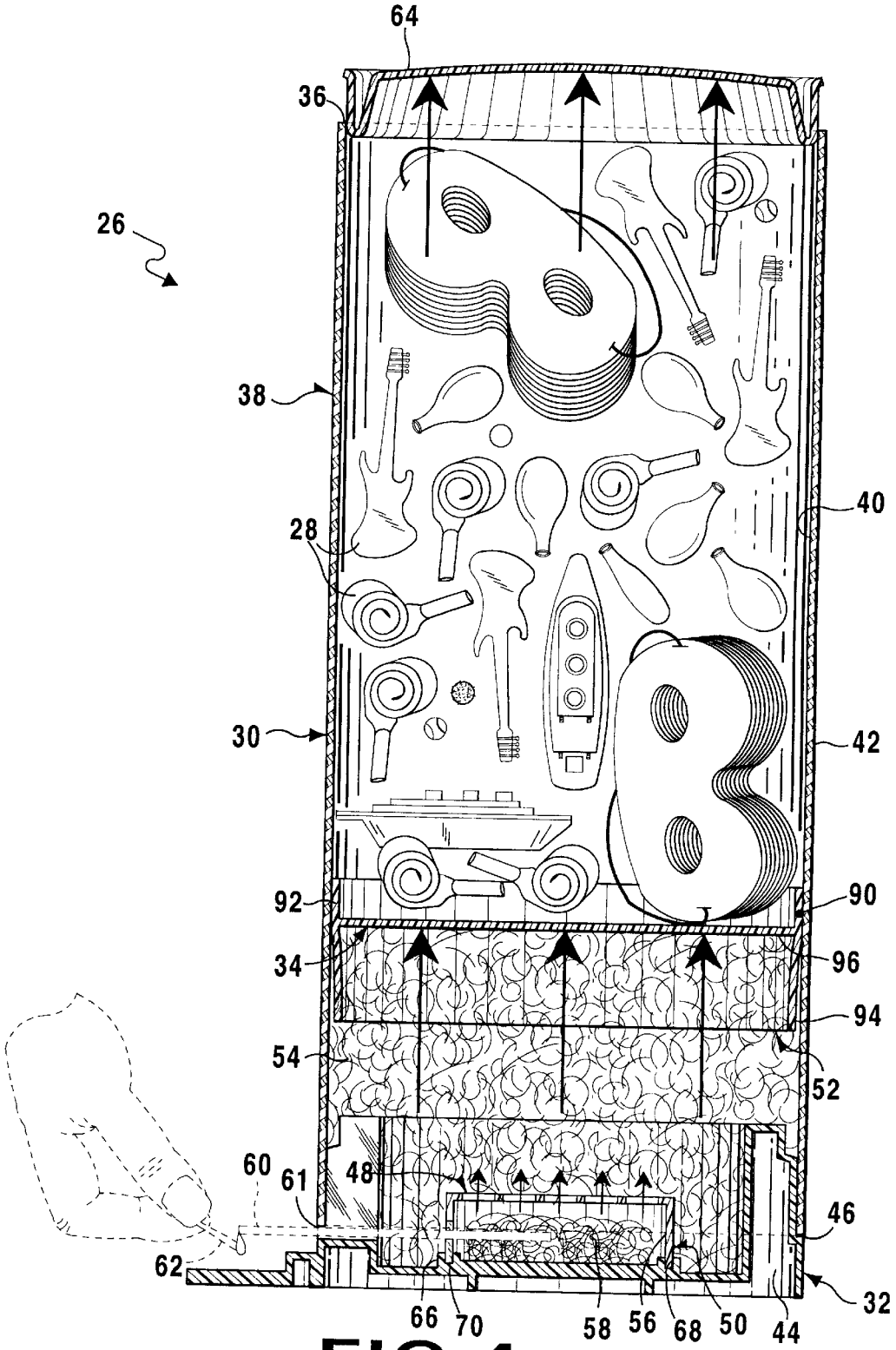
FIG. 4 is a cross sectional view similar to FIG. 3, showing the fuse being ignited and the movable base starting to move upward by the force of the expanding gas.
Figure 5:
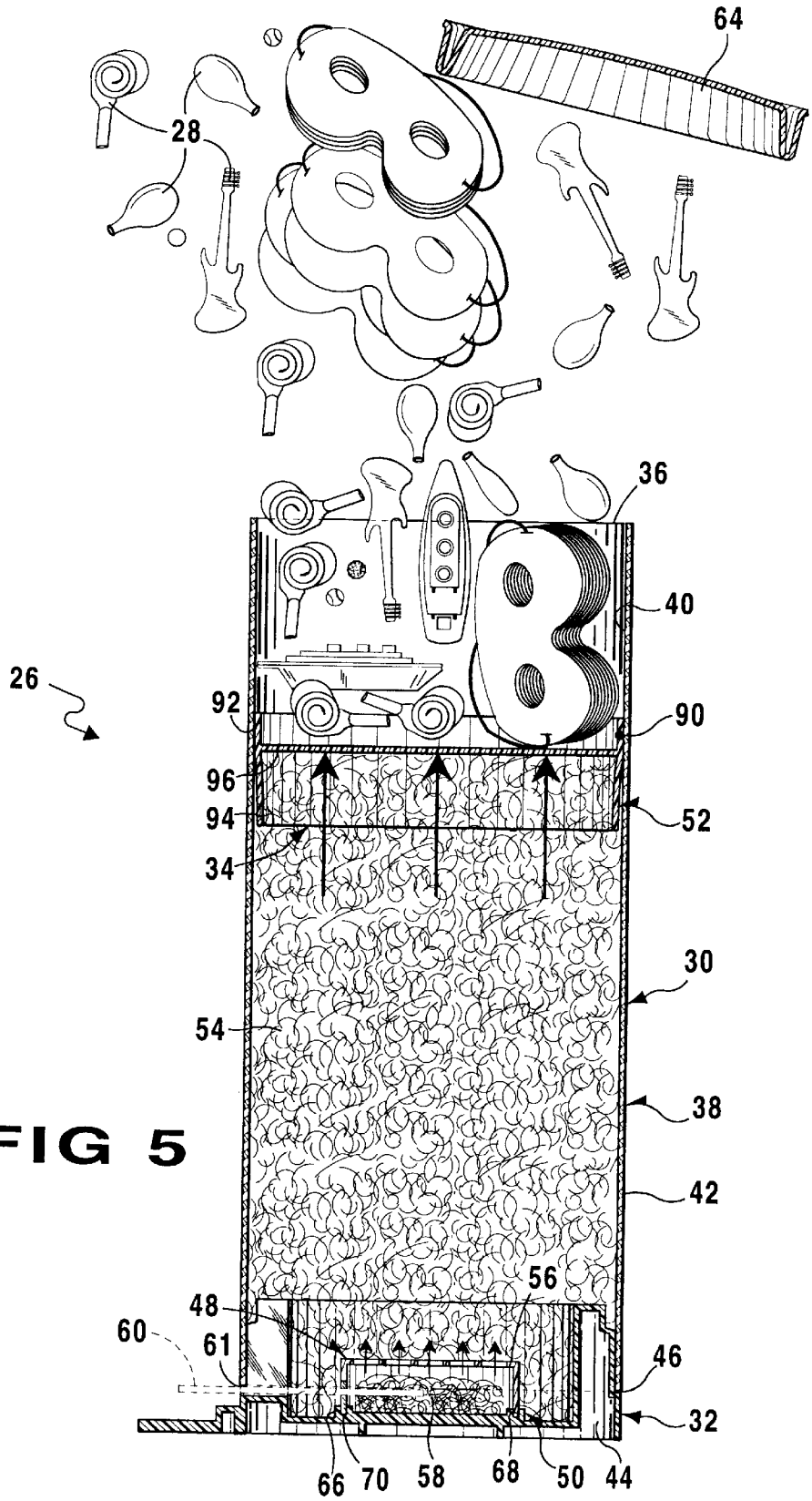
FIG. 5 is a cross sectional view similar to FIG. 4, showing the movable base traveling to the open top end of the canister, propelling the novelty items and the lid therefrom.
Figure 6:
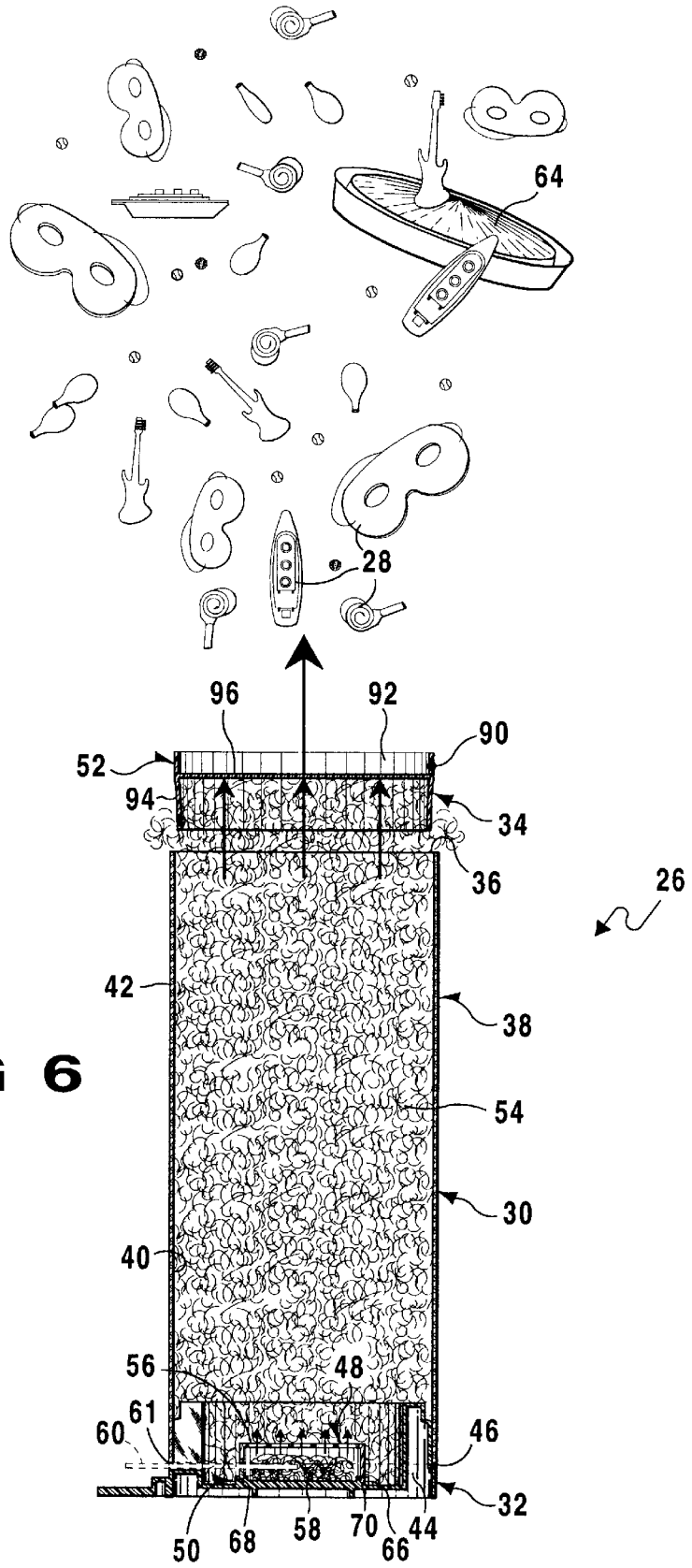
FIG. 6 is a cross sectional view similar to FIG. 5, showing the movable base leaving the open to end of the canister, while the novelty items are propelled in all directions.
Figure 8:
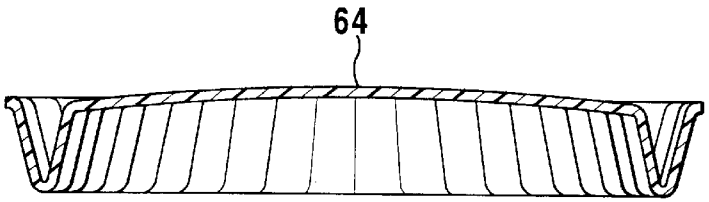
FIG. 8 is a cross sectional view of the lid taken along line 8—8 in FIG. 7.
Figure 9:
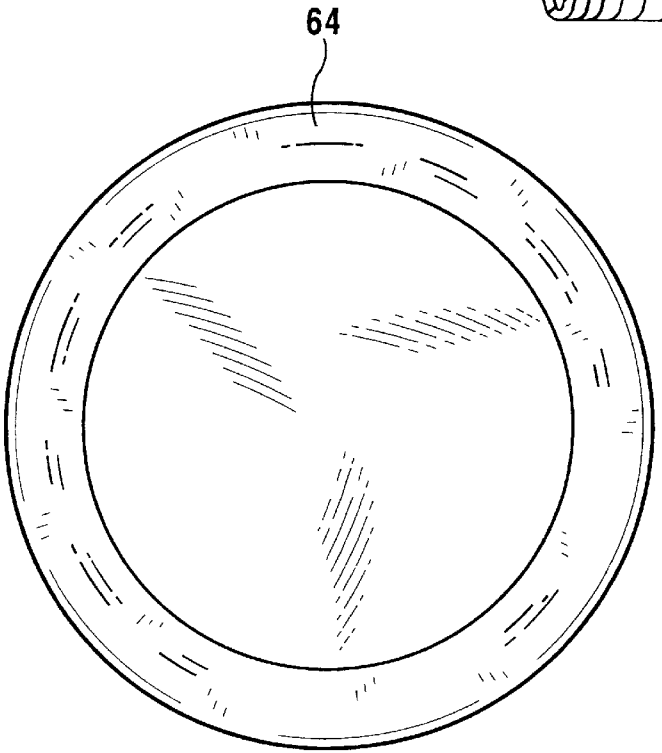
FIG. 9 is a top plan view of the lid taken in the direction of arrow 9 in FIG. 7.
Figure 10:
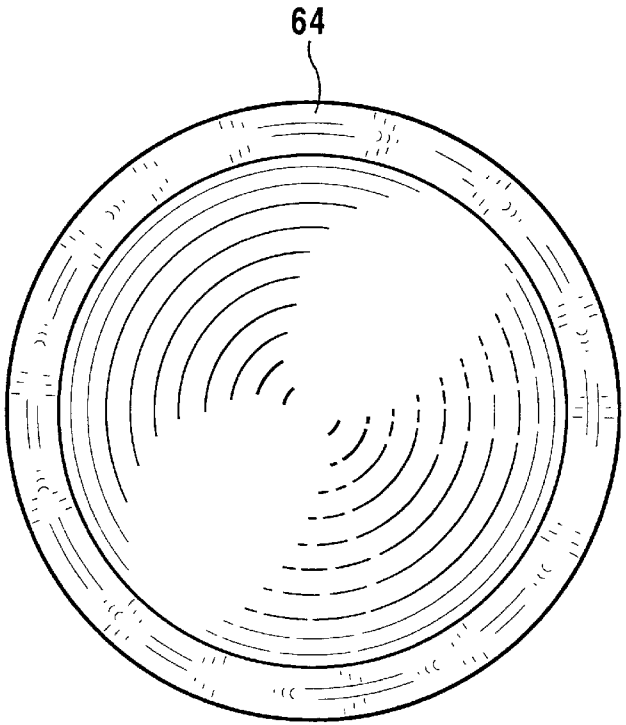
FIG. 10 is a bottom plan view of the lid taken in the direction of arrow 10 in FIG. 7.
Figure 12:
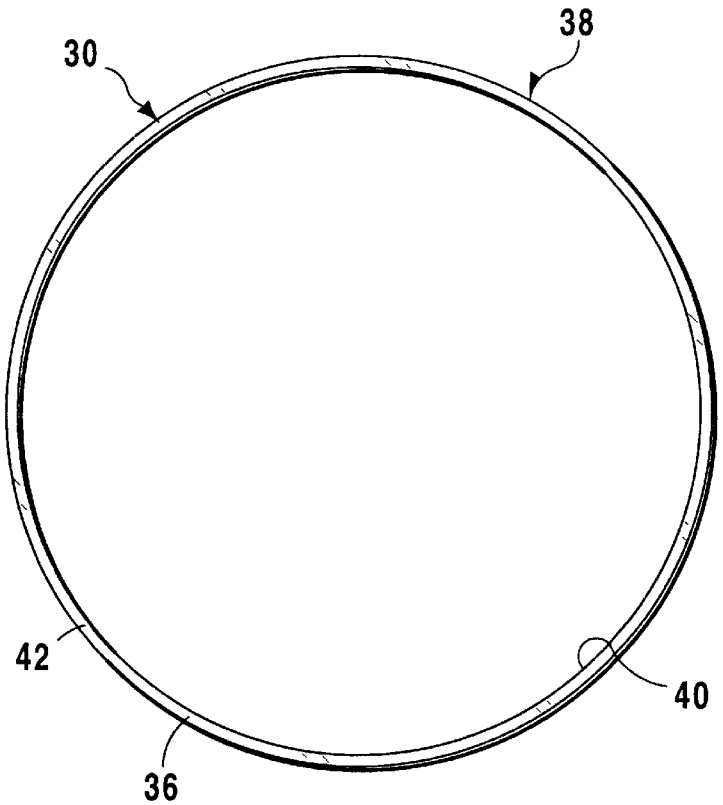
FIG. 12 is a top plan view of the canister taken in the direction of arrow 12 in FIG. 7.
Figure 11:
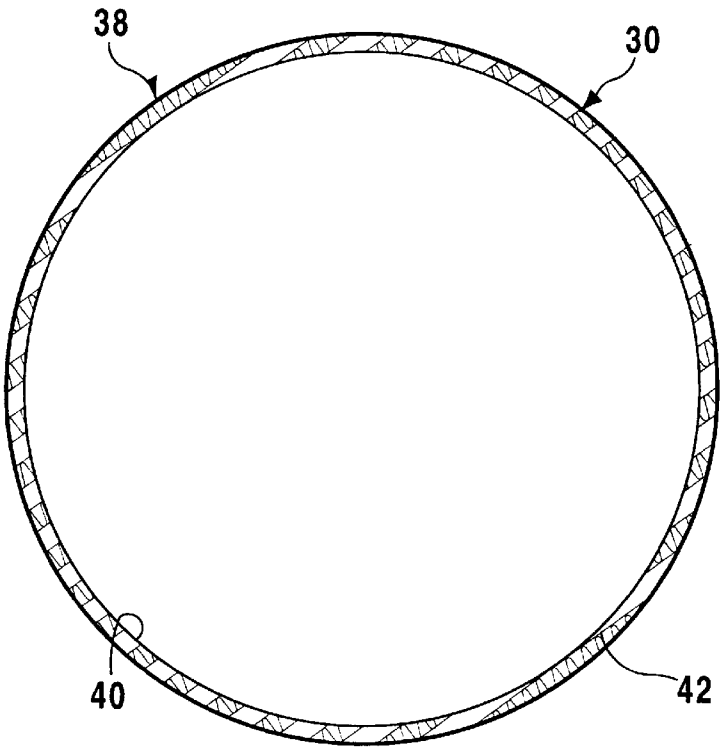
FIG. 11 is a cross sectional view of the canister taken along line 11—11 in FIG. 7.
Figure 13:
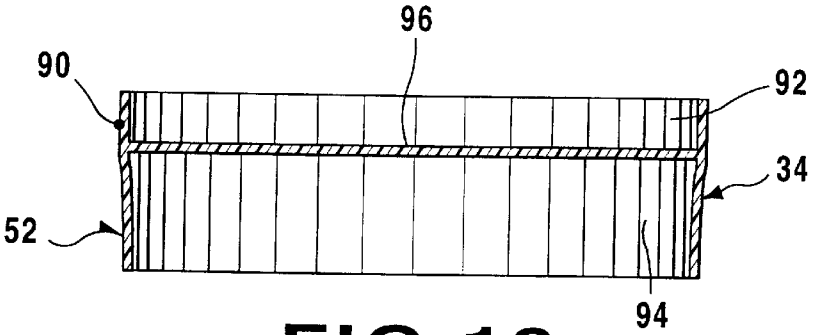
FIG. 13 is a cross sectional view of the movable base taken along line 13—13 in FIG. 7.
Figure 14:
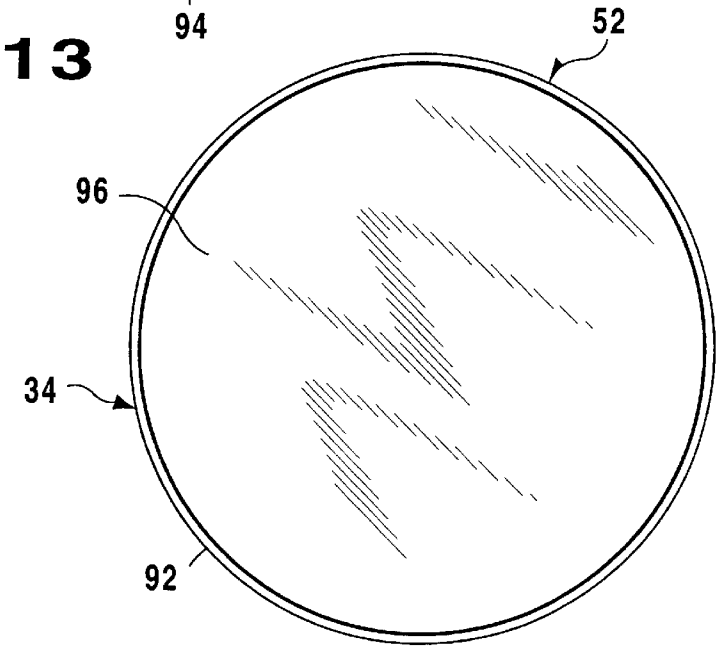
FIG. 14 is a top plan view of the movable base taken in the direction of arrow 14 in FIG. 7.
Figure 15:
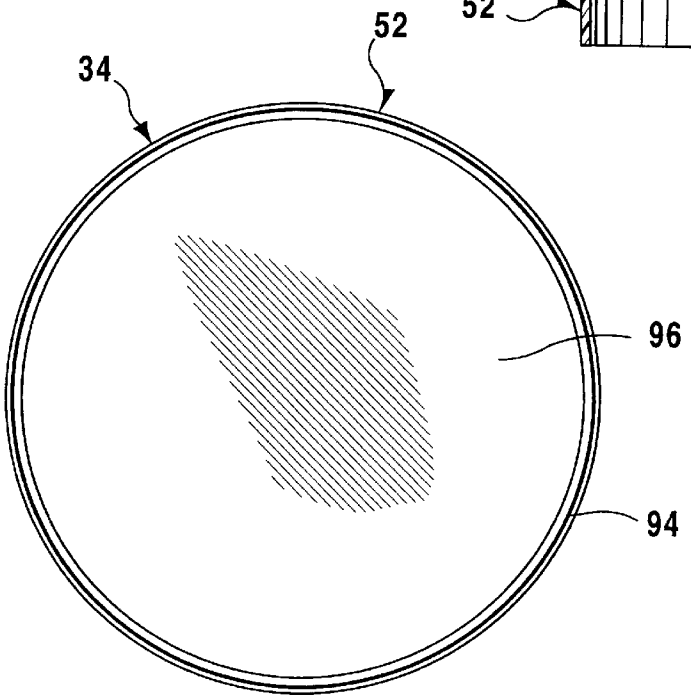
FIG. 15 is a bottom plan view of the movable base taken in the direction of arrow 15 in FIG. 7.
Figure 16:
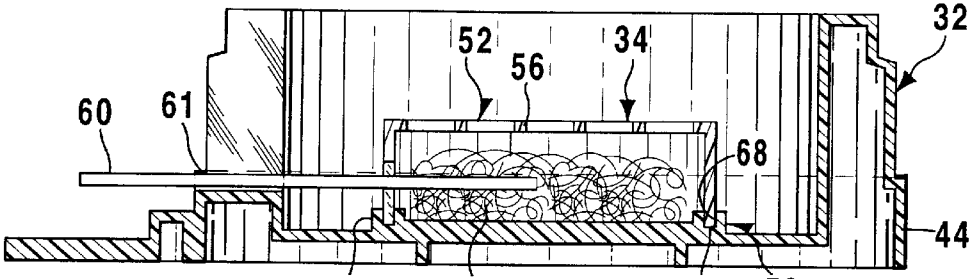
FIG. 16 is a cross sectional view of the stationary base taken along line 16—16 in FIG. 7.
Figure 17:
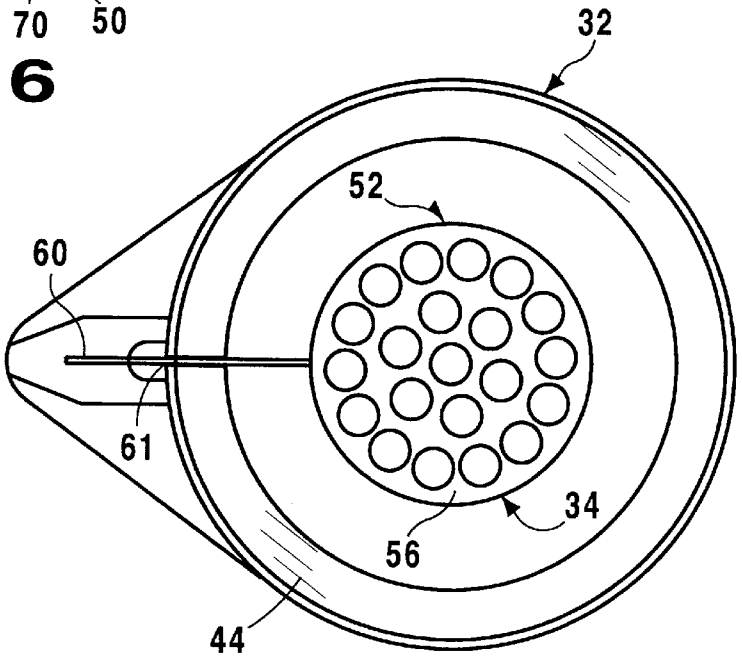
FIG. 17 is a top plan view of the stationary base taken in the direction of arrow 17 in FIG. 7.
Figure 18:
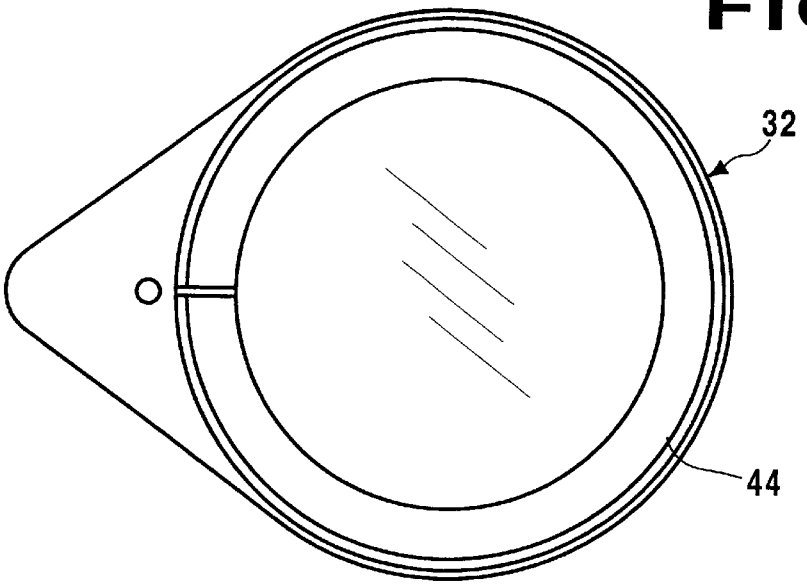
FIG. 18 is a bottom plan view of the stationary base taken in the direction of arrow 18 in FIG. 7.

Turning now descriptively to the drawings, in which similar reference characters denote similar elements throughout the several views, FIGS. 1 through 24 illustrate the present invention being a device 26 for propelling novelty items 28. With regard to the reference numerals used, the following numbering is used throughout the various drawing figures.

26 device
28 novelty item
30 holding structure of 26 for 28
32 supporting component of 26 for 30
34 ejecting facility of 26 in 32 for 28
36 open top end of 30
38 canister for 30
40 compartment in 38
42 cylindrical tube for 38
44 stationary base for 32
46 bottom end of 30
48 propellant cartridge of 34
50 mounting assembly of 34
52 movable base of 34
54 expanding gas from 48
56 perforated cylindrical housing of 48
58 nitrocellulose base propellant of 48
60 fuse of 48
61 side of 32
62 match
64 lid of 26
66 collar of 50 on 32
68 top annular groove in 66
70 open bottom edge of 56 in 68
72 bottom plate of 50
74 collar on 72
76 top annular groove in 74
78 adhesive material of 50
80 bottom plate of 50
82 collar on 80
84 top annular groove in 82
86 snap fastener of 50
88 socket in 32
90 flexible soft material of 52
92 top portion of 52
94 bottom portion of 52
96 flat horizontal platform of 52
98 cone of 52 on 96
100 inwardly curved truncated core of 52 on 96

The device 26 consists of a structure 30 for holding the novelty items 28. A component 32 is for supporting the holding structure 30 in an upright position. A facility 34 in the supporting component 32 is for ejecting the novelty items 28 out of an open top end 36 of the holding structure 30 when activated.

Holding structure 30 is a canister 38 having a compartment 40 therein. Canister 38 is a cylindrical tube 42. Supporting component 32 is a stationary base 44 which connects to a bottom end 46 of holding structure 30.

Ejecting facility 34 includes a propellant cartridge 48. An assembly 50 is for mounting propellant cartridge 48 onto supporting component 32 at bottom end 46 of the holding structure 30. A movable base 52 is placed within holding structure 30 on supporting component 32, between propellant cartridge 48 and novelty items 28. When propellant cartridge 48 is activated, movable base 52 will travel upwardly by a force of expanding gas 54 released from propellant cartridge 48 to eject novelty items 28 out of open top end 36 of holding structure 30.

Propellant cartridge 48 consists of a perforated cylindrical housing 56. A nitrocellulose base propellant 58 is carried within perforated cylindrical housing 56. A fuse 60 extends from nitrocellulose base propellant 58 within perforated cylindrical housing 56 and out of a side 61 of supporting component 32. When fuse 60 is lit by a match 62, nitrocellulose base propellant 58 will produce the expanding gas 54.

A lid 64 fits in a releasable manner upon open top end 36 of holding structure 30, to keep novelty items 28 within holding structure 30 during handling. The lid 64 will pop off of open top end 36 of holding structure 30, when the ejecting facility 34 is activated.

The mounting assembly 50, as shown in FIGS. 3 through 6 and 16, is a collar 66 integral with the supporting component 32. Collar 66 has a top annular groove 68 thereabout, so that an open bottom edge 70 of perforated cylindrical housing 56 can be retained within top annular groove 68.

Figure 19:
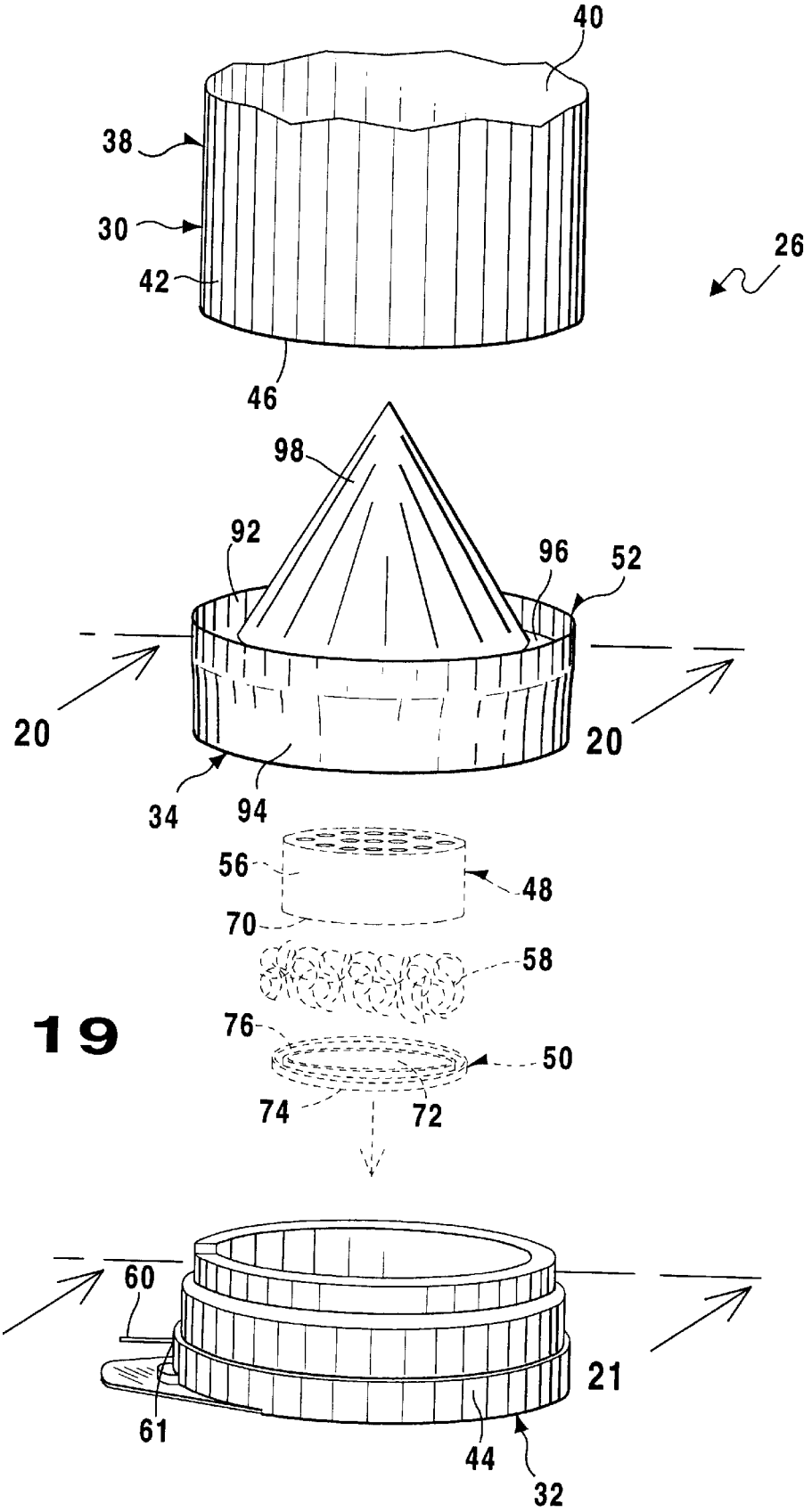
FIG. 19 is an exploded perspective view with parts broken away and removed, showing a second embodiment movable base and stationary base.
Figure 21:
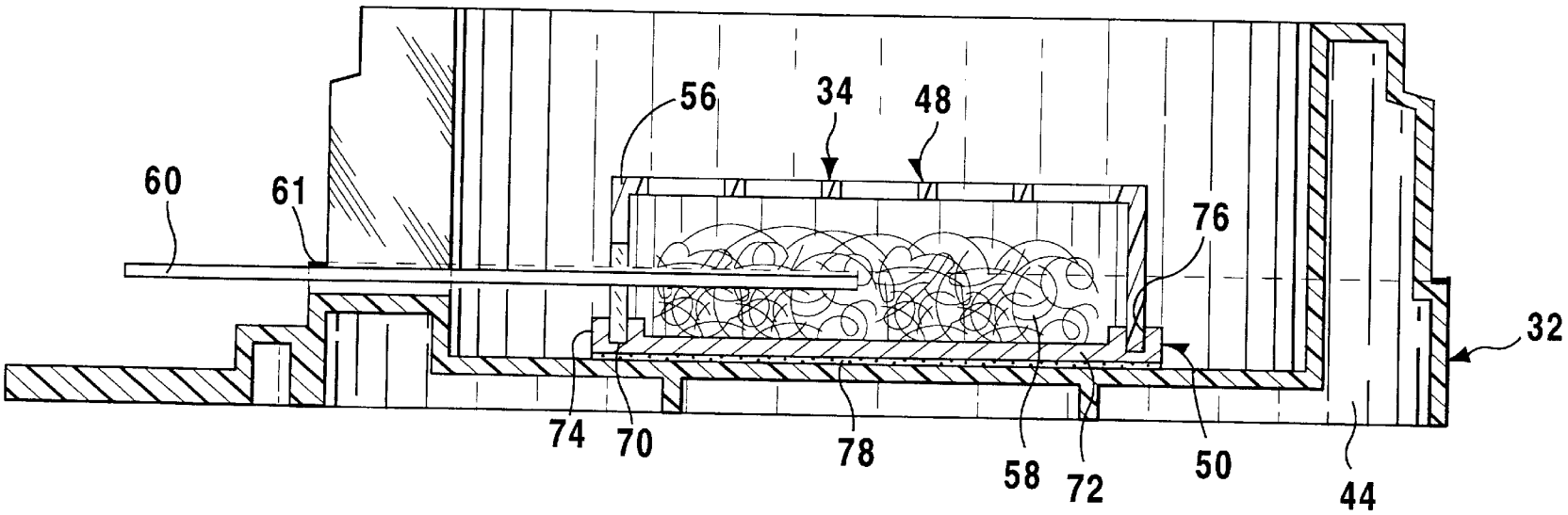
FIG. 21 is a cross sectional view of the second embodiment stationary base, taken along line 21—21 in FIG. 19.

The mounting assembly 50, as shown in FIGS. 19 and 21, includes a bottom plate 72 having a collar 74 with a top annular groove 76 thereabout. Open bottom edge 70 of perforated cylindrical housing 56 can be retained within top annular grooves 76. An adhesive material 78 is applied between bottom plate 72 and supporting component 32.

Figure 22:
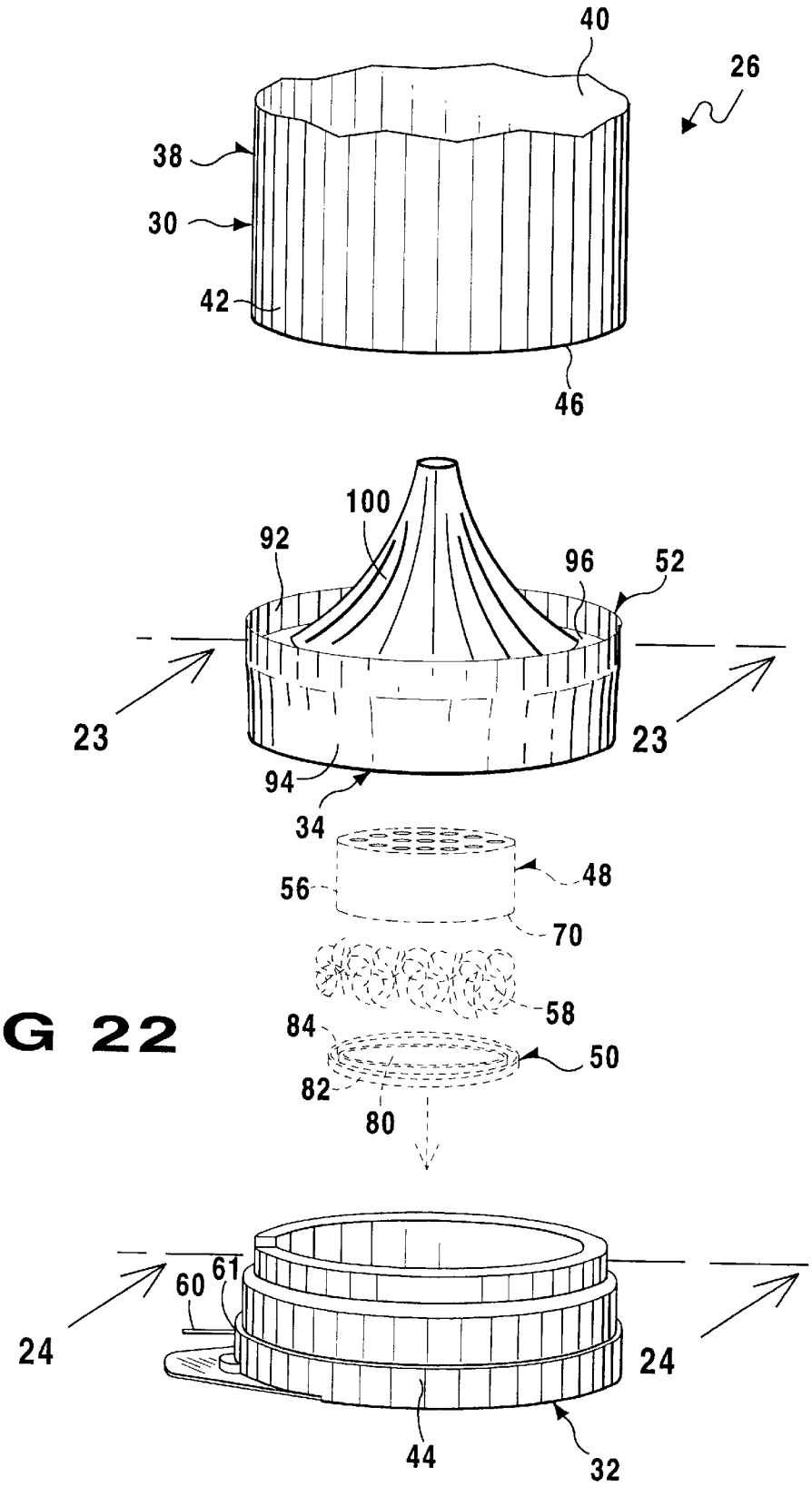
FIG. 22 is an exploded perspective view with parts broken away and removed, showing a third embodiment movable base and stationary base.
Figure 24:
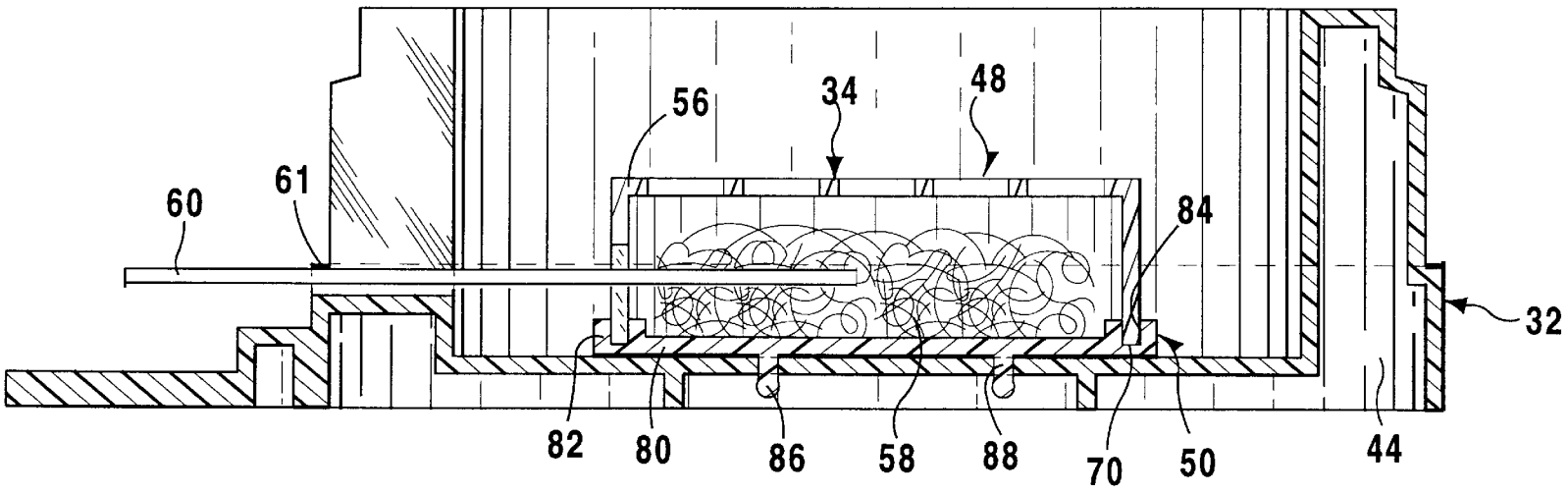
FIG. 24 is a cross sectional view of the third embodiment stationary base taken along line 24—24 in FIG. 22.

The mounting assembly 50, as shown in FIGS. 22 and 24, comprises a bottom plate 80 having a collar 82 with a top annular groove 84 thereabout. Open bottom edge 70 of the perforated cylindrical housing 56 can be retained within top annular groove 84. A plurality of snap fasteners 86 extend downwardly from bottom plate 80, to engage with a plurality of sockets 88 in the supporting component 32.

The movable base 52 is fabricated out of a flexible soft material 90, in which a top portion 92 is slightly larger than a bottom portion 94, so as to maintain a tight seal with the holding structure 30 during its travel upwardly. A flat horizontal platform 96 is positioned between the top portion 92 and bottom portion 94.

Figure 20:
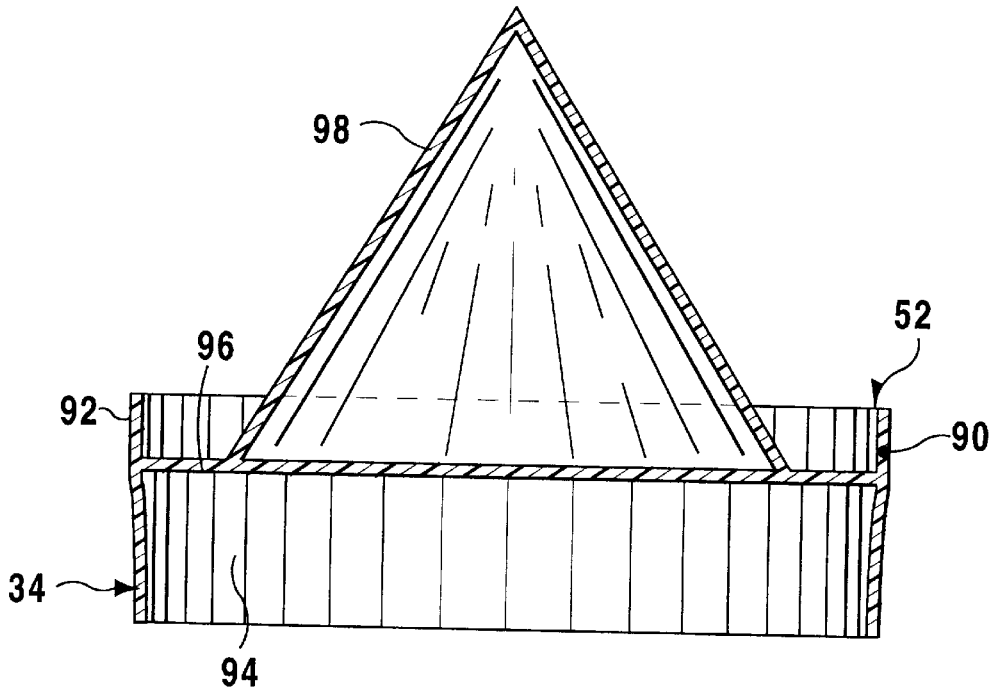
FIG. 20 is a cross sectional view of the second embodiment movable base, taken along line 20—20 in FIG. 19.
Figure 23:
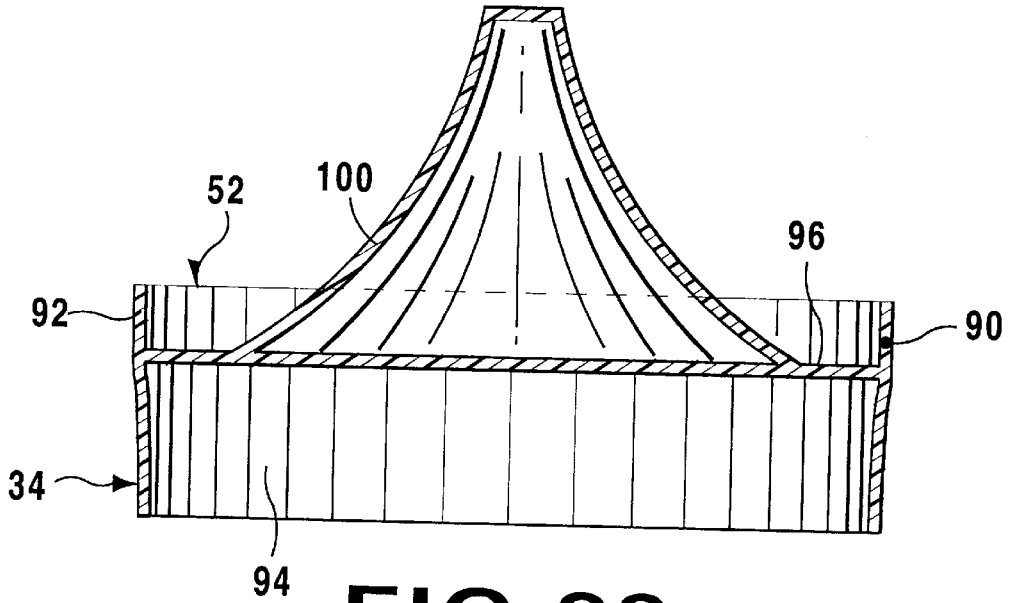
FIG. 23 is a cross sectional view of the third embodiment movable base taken along line 23—23 in FIG. 22.

In FIGS. 19 and 20, the movable base 52 further includes a cone 98 extending upwardly from flat horizontal platform 96, to help disperse novelty items 28 over a larger area. In FIGS. 22 and 24, the movable base 52 further contains an inwardly curved truncated cone 100 extending upwardly from flat horizontal platform 96, to help disperse novelty items 28 over a larger area.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A device for propelling novelty items comprising:

a) means for holding said novelty items;

b) means for supporting said holding means in an upright position; and c) means in said supporting means, for ejecting said novelty items out of an open top end of said holding means when activated, said ejecting means including:

i) a propellant cartridge including a cylindrical housing; a nitrocellulose base propellant carried within said perforated cylindrical housing; and a fuse extending from said nitrocellulose base propellant within said perforated cylindrical housing and out of a side of said supporting means, so that when said fuse is lit by a match said nitrocellulose base propellant will produce said expanding gas;

ii) means for mounting said propellant cartridge onto said supporting means at a bottom end of said holding means, said mounting means including a collar integral with said supporting means, said collar having a top annular groove thereabout, so that an open bottom edge of said perforated cylindrical housing can be retained within said top annular groove; and iii) a movable base placed within said holding means on said supporting means between said propellant cartridge and said novelty items, so that when said propellant cartridge is activated, said movable base will travel upwardly by a force of expanding gas released from said propellant cartridge to eject said novelty items out of said open top end of said holding means.

2. A device for propelling novelty items as recited in claim 1, wherein said holding means is a canister having a compartment therein.

3. A device for propelling novelty items as recited in claim 2, wherein said canister is a cylindrical tube.

4. A device for propelling novelty items as recited in claim 3, wherein said supporting means is a stationary base which connects to a bottom end of said holding means.

5. A device for propelling novelty items as recited in claim 4, further including a lid which fits in a releasable manner upon said open top end of said holding means to keep said novelty items within said holding means during handling, and will pop off of said open top end of said holding means when said ejecting means is activated.

6. A device for propelling novelty items as recited in claim 5, wherein said mounting means includes:

a) a bottom plate having a collar with a top annular groove thereabout, so that an open bottom edge of said perforated cylindrical housing can be retained within said top annular groove; and b) an adhesive material applied between said bottom plate and said supporting means.

7. A device for propelling novelty items as recited in claim 5, wherein said mounting means includes:

a) a bottom plate having a collar with a top annular groove thereabout, so that an open bottom edge of said perforated cylindrical housing can be retained within said top annular groove; and b) a plurality of snap fasteners extending downwardly from said bottom plate to engage with a plurality of sockets in said supporting means.

8. A device for propelling novelty items as recited in claim 5, wherein said movable base is fabricated out of a flexible soft material in which a top portion is slightly larger than a bottom portion, so as to maintain a tight seal with said holding means during its travel upwardly, and a flat horizontal platform is positioned between said top portion and said bottom portion.

9. A device for propelling novelty items as recited in claim 8, wherein said movable base further includes a cone extending upwardly from said flat horizontal platform, to help disperse said novelty items over a larger area.

10. A device for propelling novelty items as recited in claim 8, wherein said movable base further includes an inwardly curved truncated cone extending upwardly from said flat horizontal platform, to help disperse said novelty items over a larger area.

11. A device for propelling novelty items as recited in claim 1, wherein said supporting means is a stationary base which connects to a bottom end of said holding means.

12. A device for propelling novelty items as recited in claim 1, further including a lid which fits in a releasable manner upon said open top end of said holding means to keep said novelty items within said holding means during handling, and will pop off of said open top end of said holding means when said ejecting means is activated.

13. A device for propelling novelty items as recited in claim 1, wherein said mounting means includes:

a) a bottom plate having a collar with a top annular groove thereabout, so that an open bottom edge of said perforated cylindrical housing can be retained within said top annular groove; and b) an adhesive material applied between said bottom plate and said supporting means.

14. A device for propelling novelty items as recited in claim 1, wherein said mounting means includes:

a) a bottom plate having a collar with a top annular groove thereabout, so that an open bottom edge of said perforated cylindrical housing can be retained within said top annular groove; and b) a plurality of snap fasteners extending downwardly from said bottom plate to engage with a plurality of sockets in said supporting means.

15. A device for propelling novelty items as recited in claim 1, wherein said movable base is fabricated out of a flexible soft material in which a top portion is slightly larger than a bottom portion, so as to maintain a tight seal with said holding means during its travel upwardly, and a flat horizontal platform is positioned between said top portion and said bottom portion.

16. A device for propelling novelty items as recited in claim 15, wherein said movable base further includes a cone extending upwardly from said flat horizontal platform, to help disperse said novelty items over a larger area.

17. A device for propelling novelty items as recited in claim 15, wherein said movable base further includes an inwardly curved truncated cone extending upwardly from said flat horizontal platform, to help disperse said novelty items over a larger area.

* * * * *